US010072437B1

(12) United States Patent
Padron

(10) Patent No.: US 10,072,437 B1
(45) Date of Patent: Sep. 11, 2018

(54) MAGNETIC STRAKING SUCH AS FOR UTILITY OR COMMUNICATIONS TOWER

(71) Applicant: Sabre Communications Corporation, Sioux City, IA (US)

(72) Inventor: Leo Dan Padron, Springtown, TX (US)

(73) Assignee: Sabre Communications Corporation, Sioux City, IA (US)

( * ) Notice: Subject to any disclaimer, the term of this patent is extended or adjusted under 35 U.S.C. 154(b) by 0 days.

(21) Appl. No.: 15/644,634

(22) Filed: Jul. 7, 2017

(51) Int. Cl.
*E04H 12/28* (2006.01)
*E04H 12/08* (2006.01)

(52) U.S. Cl.
CPC ..... *E04H 12/08* (2013.01)

(58) Field of Classification Search
CPC ..... E04H 12/08
USPC ..... 52/854
See application file for complete search history.

(56) References Cited

U.S. PATENT DOCUMENTS 3,076,533 A 2/1963 Scruton et al.
3,517,774 A * 6/1970 Meyer ..... B66B 7/022 187/239
3,826,340 A 7/1974 Brokaw
6,347,911 B1 2/2002 Blair et al.
8,256,993 B2 * 9/2012 Branchut ..... E21B 17/01 166/350
8,408,154 B2 * 4/2013 Haney ..... B63B 21/502 114/243
9,567,745 B2 2/2017 Moeller et al.
2004/0258485 A1 12/2004 Steinkamp et al.
2007/0231077 A1 * 10/2007 Burgess ..... B63B 21/502 405/216
2009/0016897 A1 * 1/2009 Olgaard ..... E04H 12/08 416/244 R

FOREIGN PATENT DOCUMENTS

EP 3029313 A1 6/2016

* cited by examiner

*Primary Examiner* — Charles A Fox
*Assistant Examiner* — James Buckle, Jr.
(74) *Attorney, Agent, or Firm* — Schwegman Lundberg & Woessner, P.A.

(57) ABSTRACT

Magnetic straking can optionally be temporarily attached to a ferromagnetic structure or other structure capable of magnetic attachment thereto, allowing observation or testing of the structure's performance before optional permanent attaching of such straking to the structure, such as by welding or the like.

11 Claims, 2 Drawing Sheets

MAGNETIC STRAKING SUCH AS FOR UTILITY OR COMMUNICATIONS TOWER

TECHNICAL FIELD

This document pertains generally, but not by way of limitation, to structures exposed to fluid flow, and more particularly, but not by way of limitation to magnetic straking such as for a utility or communications tower.

BACKGROUND

In a utility or communications structure or other structure that is exposed to fluid flow, such as wind flow, vibration can be induced in the structure due to the wind or other fluid flow to which it is exposed.

SUMMARY

The present inventors have recognized, among other things, that such wind or other flow-induced vibration can impact the integrity of the structure, leading to cracking, premature wear, or even structural failure. For example, vortex shedding is a phenomena in which oscillating flow can take place when air moves past a structure at certain velocities, which can depend upon the size and shape of the structure. Alternating pressure vortices can be created downwind from the structure, and can detach periodically from either side of the structure. The structure can tend to move toward the low-pressure zone. If the vortex shedding matches the resonance frequency of the structure, the structure can begin to resonate. Harmonic vibrations can occur, which can create the potential for structural damage or failure.

A fin or other straking can be used to interfere with wind flow past a structure, such as in a manner to inhibit or dampen vortex shedding. For example, a vertical cylindrical structure may have a protruding spiral fin about the structure such as to reduce or inhibit vortex shedding, thereby reducing or avoiding resonance or other structural wear upon the structure. Finite element analysis (FEA), such as can be performed using a computer simulation, can be used to determine the exact size, shape, and arrangement of a fin or other straking. The process of performing FEA simulation to determine a straking configuration, and then implementing such straking on a structure, can be time-consuming, tedious, and expensive. In practice, it is sometimes easier to iteratively weld straking elements piecemeal onto a metal structure such as a utility or communications pole or tower, and then test the amount of vibration reduction that is obtained for the welded arrangement of straking elements. If insufficient damping is obtained, more straking elements can be welded onto the structure. This can avoid the tedious process of FEA simulation and analysis. However, welding permanently attaches the straking element to the pole. This can lead to inefficient usage of straking materials if too many straking elements are welded to the pole. Moreover, if the straking arrangement is unsuitable, for example increasing flow-induced vibration, or insufficiently or incorrectly damping such vibration, it can be difficult to remove such welded-on straking elements.

Accordingly, the present inventors have recognized that magnetic straking elements can help by allowing temporary magnetic affixation to a ferromagnetic metal structure, such as is often used in a utility or communications pole or structure. This allows a user to magnetically mount one or more magnetic straking elements at desired locations upon the utility or communications pole or other structure, observe or test the effect of such straking elements on the structure, such as when the structure is exposed to wind flow, and then either move (or add or remove) one or more selected straking elements, until the user is satisfied with the performance of the one or more straking elements. Then, such straking elements can optionally be welded or otherwise permanently attached to the structure. This can avoid the tedious process of FEA simulation and analysis, and allow easy and convenient trial-and-error configuration and optional reconfiguration. At the very least, observation or verification of performance of the straking elements can be accomplished before permanent affixation of the one or more straking elements to the structure is performed.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

This document describes magnetic straking that can optionally be temporarily attached to a ferromagnetic structure, allowing observation or testing of the structure's performance before optional permanent attaching of such straking to the structure, such as by welding or the like.

Figure 1C:
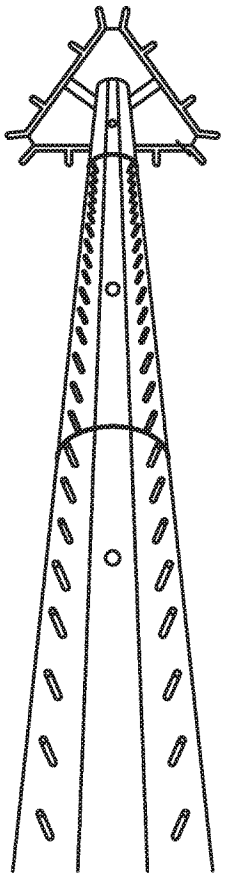
FIGS. 1A, 1B, and 1C show illustrative non-limiting examples of utility or communications structures, such as to which wireless communications equipment or wired communications or power lines can be attached.
Figure 1B:
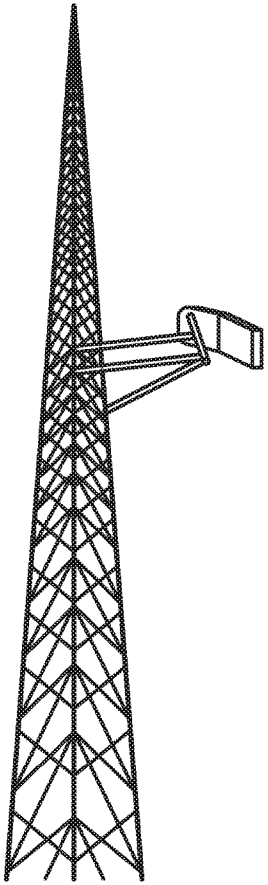
Figure 1A:
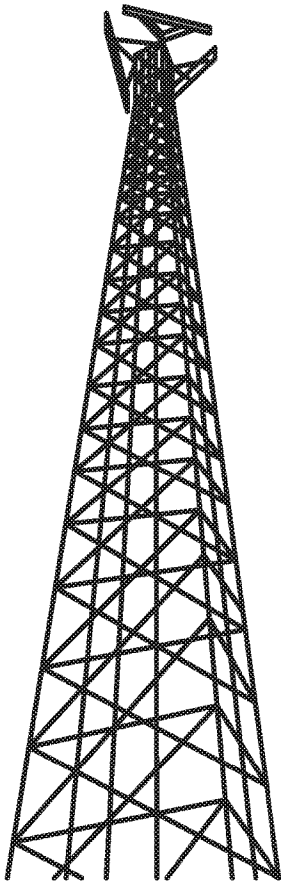

FIGS. 1A, 1B, and 1C show illustrative non-limiting examples of utility or communications structures, such as to which wireless communications equipment or wired communications or power lines can be attached. FIG. 1A shows an illustrative example of a self-supporting tower. FIG. 1B shows an illustrative example of a guyed tower. FIG. 1C shows an illustrative example of a monopole, such as can be generally cylindrical, but with faceted flat sides forming a polygonal cross-section to provide the generally cylindrical structure. All or a portion of any of the structures shown in FIGS. 1A, 1B, 1C, can include a material that is ferromagnetic or otherwise capable of receiving a permanent magnet for magnetic attachment thereto.

Figure 2:
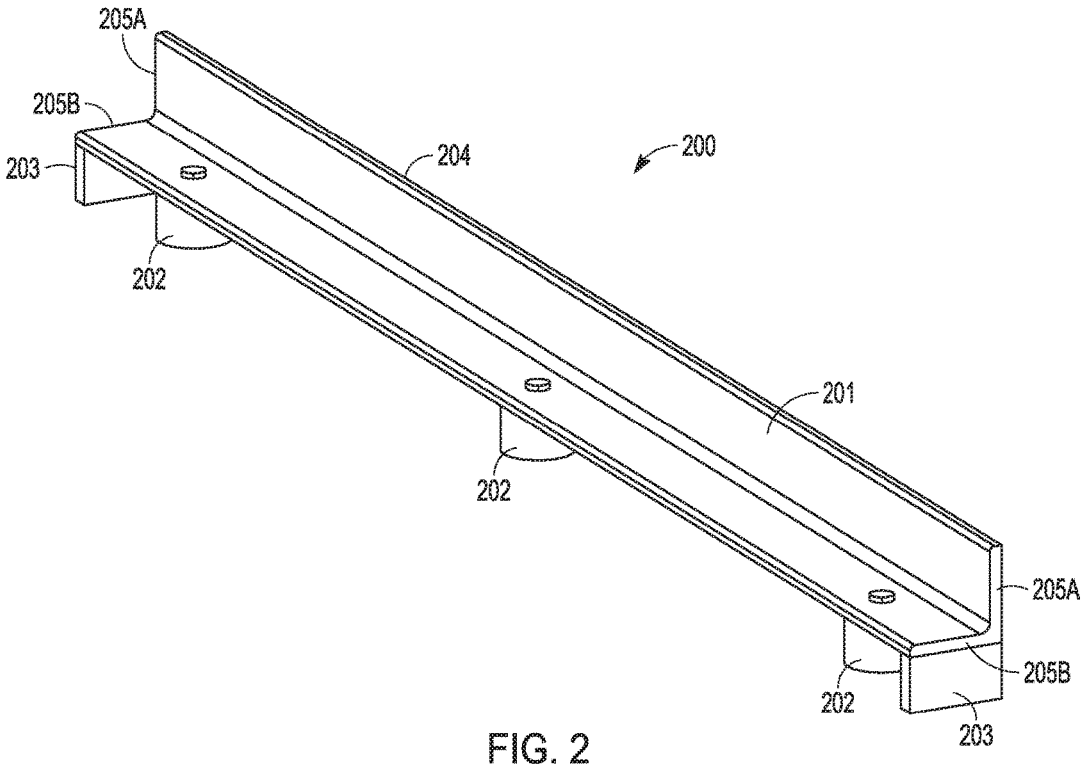
FIG. 2 shows an illustrative example of an elongate magnetic straking element.

FIG. 2 shows an illustrative example of an elongate magnetic straking element 200. In this example, the straking 200 can include an elongate section of angle iron 201 (or other angle material). In an example, the angle iron 201 can be vertically-oriented with respect to a vertically-oriented monopole or other structure extending upward from a base located on the ground, a rooftop, or elsewhere. For example, the straking 200 can be magnetically vertically attached on a flat faceted side of the vertical monopole shown in FIG. 1C. Such magnetic attachment can be provided using one or more permanent magnets 202. The one or more permanent magnets 202 can be bolted (such as shown) or otherwise attached to a face 205B of the angle iron 201 at one or more desired locations. For example, the magnets 202 can be affixed such as at or near one or more ends of the angle iron 201, at one or more intervening locations along its length, or both. The angle iron 201 can include end offsets 203, such as can extend orthogonally from the face 205B of the angle iron 201 that extends parallel to the facet of the monopole or other structure to which it can be attached. The end offsets 203 such as can be used for welding (or other mechanical, chemical, or other permanent affixation technique) the angle iron 201 onto the faceted side of the monopole or other structure, such as after determining that the magnetically attached locations of the magnetic straking element 200 are indeed the desired locations for more permanent attachment. A height of the end offsets 203 can match a height of the permanent magnets 202, such that the end offsets 203 can be conveniently welded to the underlying structure while the straking 200 is magnetically attached thereto using the permanent magnets 202. Other offsets 203 can be provided elsewhere along the length of the straking 200 for allowing further welding, if desired. The magnetic straking element 200 can provide a fin 204 that juts out in a non-parallel (e.g., orthogonal) direction from the faceted side of the monopole or other structure. The fin 204 can disrupt wind flow around the structure, such as to provide fine tuning of wind flow around the structure, such as to inhibit, reduce, or avoid vortex shedding. The height of the permanent magnets 202 and the end offsets 203 can be selected to obtain a desired spacing from the underlying structure, which can help adjust the wind flow around the structure. Similarly, a height of the fin 204 can be selected to provide a desired degree of disruption of wind flow, such as to inhibit or prevent or accommodate vortex shedding.

This fin 204 can be provided by the face 205A of the angle iron 201 that can extend orthogonally to a faceted side of the monopole or other structure. The straking element 200 can optionally also help provide structural reinforcement to the structure to which it is affixed, for example, in addition to serving the purpose of tuning wind flow around the structure, particularly after the straking element 200 is permanently affixed to the structure, after its performance has been observed, measured, or verified while being magnetically attached to the structure before being permanently attached thereto.

The fin 204 need not be orthogonal, but can jut outward at a non-right angle, if desired. The magnetic straking element 200 need not include an angle iron 201, but can include another structure that can jut out from the monopole or other structure. For example, an elongate triangle iron element can be used as the magnetic straking element instead of an angle iron element, if desired. The triangle iron element can have a triangular cross section at any orthogonal cutline along its length. The terms "angle iron" and "triangle iron" are intended to refer to common terminology for such materials—however, they need not be made of an iron material, and need not be ferromagnetic. For example, a carbon fiber or a plastic or other polymeric magnetic straking element can be used, with permanent magnets attached thereto. When a magnetic material is used for all or part of the elongated member of the magnetic straking 200, the permanent magnets 202 can optionally be integrated into the elongate magnetic material of the elongate magnetic straking element 200. The magnetic straking element 200 need not be attached in longitudinal alignment with the monopole or other structure, but, if desired, can be attached at a desired angle thereto, such as to form a spiral-like or other configuration of multiple magnetic straking elements 200. The elongate magnetic straking elements 200 need not be linear, but can be curved, if desired.

As explained herein, providing magnets 202 to allow optional temporary attachment to an underlying utility or communications tower or pole structure that is capable of magnetic attachment can allow reconfiguration of the magnetic straking elements 200 such as during an observation or evaluation period.

Although particular examples have been described with a utility or communications monopole as the underlying structure, any other structure capable of magnetic attachment thereto using permanent magnets 202 can use the present approach.

Also, although particular examples have been described with respect to addressing vortex shedding due to wind flow, structures subject to similar effects from other fluid flow (e.g., underwater structures subject to water flow) can similarly advantageously use the present approach, such as to allow observation or reconsideration before more permanent attachment.

VARIOUS NOTES

The above description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A magnetic straking element for magnetic attachment to a structure to provide fluid-flow adjustment around the structure, mechanical reinforcement to the structure, or both, the straking comprising:

an elongate member, including one or more permanent magnets extending from a first side of the structure for magnetic attachment to the structure;

a fin jutting outward from the elongate member from an opposing second side of the structure to adjust fluid flow around the structure when the straking is attached to the structure; and weld offsets, protruding from the first side of the structure, the weld offsets protruding to provide a height matching a height of the permanent magnets such that the weld offsets make contact with an underlying portion of the structure when the straking is magnetically attached to the underlying structure using the one or more permanent magnets, such that the weld offsets are configured to provide contact to the structure to permit welding of the straking to the structure.

2. The straking of claim 1, wherein the elongate member includes length of angle iron or other angle material.

3. The straking of claim 2, wherein at least one permanent magnet is affixed at one or both ends of the elongate member.

4. The straking of claim 3, wherein at least one permanent magnet is affixed between ends of the elongate member.

5. The straking of claim 3, wherein the at least one permanent magnet is bolted to the elongate member.

6. The straking of claim 1, wherein the fin is arranged to just orthogonally from the underlying structure when the straking is attached thereto.

7. The straking of claim 1, wherein the elongate member includes length of triangle iron or other triangle material.

8. A method of adjusting fluid flow around a structure capable of magnetic attachment thereto by a permanent magnet, the method comprising:

magnetically attaching one or more straking elements to the structure, the straking comprising: an elongate member, including one or more permanent magnets extending from a first side of the structure for magnetic attachment to the structure; a fin jutting outward from the elongate member from an opposing second side of the structure to adjust fluid flow around the structure when the straking is attached to structure; and weld offsets, protruding from the first side of the structure, the weld offsets protruding to provide a height matching a height of the permanent magnets such that the weld offsets make contact with an underlying portion of the structure when the straking is magnetically attached to the underlying structure using the one or more permanent magnets, such that the weld offsets are configured to provide contact to the structure to permit welding of the straking to the structure; and then permanently attaching the one or more straking elements to the structure.

9. The method of claim 8, further comprising evaluating the structure with one or more straking elements attached thereto to determine whether more or fewer straking elements or a different arrangement of straking elements is desired before permanently attaching the one or more straking elements to the structure.

10. The method of claim 8, wherein permanently attaching the one or more straking elements to the structure comprises welding.

11. The method of claim 8, comprising removing or moving at least one magnetically attached straking elements from or with respect to the structure before permanently attaching the one or more straking elements to the structure.

* * * * *